US008014495B2

(12) United States Patent
Lenz

(10) Patent No.: US 8,014,495 B2
(45) Date of Patent: Sep. 6, 2011

(54) CREEP-RESISTANT ROTATING ANODE PLATE WITH A LIGHT-WEIGHT DESIGN FOR ROTATING ANODE X-RAY TUBES

(75) Inventor: Eberhard Lenz, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 79 days.

(21) Appl. No.: 12/534,907

(22) Filed: Aug. 4, 2009

(65) Prior Publication Data

US 2010/0027754 A1 Feb. 4, 2010

(30) Foreign Application Priority Data

Aug. 4, 2008 (DE) ..... 10 2008 036 260

(51) Int. Cl.
*H01J 35/10* (2006.01)

(52) U.S. Cl. ..... 378/144

(58) Field of Classification Search ..... 378/143, 378/144

See application file for complete search history.

(56) References Cited

U.S. PATENT DOCUMENTS 4,939,762 A * 7/1990 Baba et al. ..... 378/144
2004/0252808 A1 12/2004 Lenz et al. ..... 378/132

* cited by examiner

*Primary Examiner* — Courtney Thomas
(74) *Attorney, Agent, or Firm* — Schiff Hardin LLP

(57) ABSTRACT

A rotating anode plate for rotating anode x-ray tubes, has a curved disc to be attached positively on a rotation center. The curved disc is formed of a material with high thermal shock resistance that is creep-resistant and simultaneously highly heat-conductive. Particularly suitable materials are ceramics made of silicon carbide (SiC) or alloys made of molybdenum-titanium-zirconium (TZM).

12 Claims, 1 Drawing Sheet

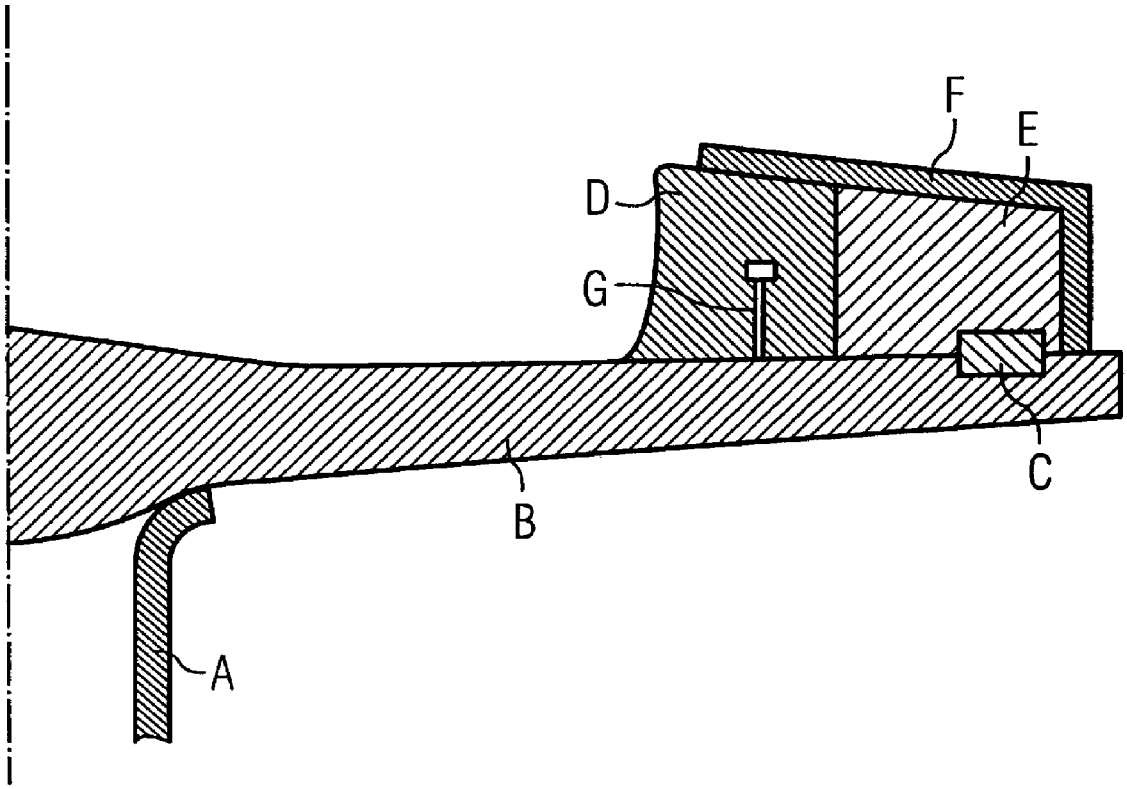
F
E
D
G
C
B
A

CREEP-RESISTANT ROTATING ANODE PLATE WITH A LIGHT-WEIGHT DESIGN FOR ROTATING ANODE X-RAY TUBES

BACKGROUND OF THE INVENTION

1. Field of the Invention

The present invention concerns an anode plate of the type suitable for use in rotating anode x-ray tubes.

2. Description of the Prior Art

In computed tomography, particular focal spot qualities in the x-ray tubes are required for better image quality in future apparatuses. These focal spot qualities are characterized by a desire that the focal spots should be smaller on the anode plates and at the same time, a higher operating capacity than is presently typical and possible with the known arrangements is necessary. This means that the power density should markedly increase, and thus the short-term (temporary) thermal load and the short-term temperature should markedly increase.

SUMMARY OF THE INVENTION

Known available materials do not permit this load increase.

An object of the present invention is to provide a rotating anode plate with which the aforementioned goals can be achieved.

This object is achieved by a rotating anode plate according to the invention wherein in order to avoid or to limit the phenomena of creep, the rotating anode plate for rotating anode x-ray tubes has a curved disc that is to be positively attached at a drive center around which the anode rotates. The curved disc is formed of a creep-resistant and simultaneously highly heat-conductive material with high thermal shock resistance. A very high creep resistance of the rotating anode plate is thereby achieved, that also contributes to achieving the sought load increase.

In an embodiment of the invention, the rotating anode plate has a curved disc that contains a ceramic material.

In an embodiment of the invention, a rotating anode plate has a curved disc that contains a ceramic made from silicon carbide (SiC). Silicon carbide (SiC) has a thermal expansion similar to that of molybdenum (Mo), but is creep-resistant, is 3.2 times lighter than molybdenum (Mo), with a density of approximately 3.15 kg/dm$^3$, and has a heat conductivity comparable to that of Mo. A desirable property of SiC is its high thermal shock resistance. This results from the advantageous combination of thermal expansion, elasticity modulus, heat conductivity and heat storage capacity.

In a further embodiment of the invention, a rotating anode plate has a curved disc that contains a molybdenum-titanium-zirconium alloy (TZM). TZM conventionally has the composition Mo 99/Ti 0.5/Zr 0.1.

In another embodiment of the invention, a rotating anode plate has a curved disc on which an anode ring is applied with positive fit (direct attachment) elements.

In a further embodiment of the invention, a rotating anode plate has an anode ring made from graphite or silicon carbide (SiC).

In another embodiment of the invention, a rotation anode plate had an anode ring that has radially oriented chambers into which small plates made from pyrolytic graphite (pyrographite) are inserted.

In another embodiment of the invention, a rotating anode plate has an anode ring with a coating that contains tungsten or a tungsten-rhenium alloy (WRe).

In another embodiment of the invention, a rotating anode plate has a number of slits in the anode ring.

In another embodiment of the invention, a rotating anode plate has a number of slits in the curved disc.

In another embodiment of the invention, a rotating anode plate has a curved disc that also contains a titanium-zirconium-molybdenum (TZM) alloy.

A rotating anode plate according to the invention can advantageously be produced by a method to in which the anode ring is soldered onto the curved disc with rigid fit elements.

In an embodiment of the method according to the invention for the production of a rotating anode plate, a heat-conductive connection from small pyrolytic graphite plates to the ring material and to the curved disc is produced in a single soldering process, and a composite material is produced in this way.

In another embodiment of method according to the invention for the production of a rotating anode plate, an x-ray-generating layer of tungsten (W) or tungsten-rhenium (WRe) is subsequently applied on this composite material by vacuum plasma spraying.

In another embodiment of method according to the invention for the production of a rotating anode plate, slits are introduced into the anode ring to reduce frozen-in thermal stresses from the soldering process.

In another embodiment of method according to the invention for the production of a rotating anode plate, slits are introduced into the curved disc in an essentially radial direction to reduce thermal stresses from the soldering process that arise in operation.

BRIEF DESCRIPTION OF THE DRAWINGS

The single FIGURE schematically illustrates a preferred embodiment of a rotating anode plate according to the invention, as a section through the rotating anode plate.

DESCRIPTION OF THE PREFERRED EMBODIMENTS

A rotating anode plate for x-ray apparatuses always has a focal spot ring (A) that rotates with high rotation speed around a plate center (C). In operation, the focal spot (and therefore the focal spot ring) heats very severely, whereby significant material stresses arise. Since the known available materials for rotating anode plate cannot allow the desired increase of the load capacity, the present invention undertakes to change the constructional mechanical design characteristics of the rotating anode plate. The speed of the rotating focal spot material should thereby be increased.

However, if the rotation speed is simply increased in the known rotating anode plates without changing the constructional mechanical design characteristics, a material load range would be reached in which the plate material creeps away due to the increased centrifugal force, and therefore intolerably out-of-balances would arise.

This unwanted effect could be avoided in that the diameter of the anode plate is increased by 20%, for example. If the previous rotation frequency is maintained, this would lead to a corresponding increase of the focal spot speed.

However, an increase of the diameter of the anode plate leads to a disproportionate enlargement of the x-ray radiator. The x-ray apparatuses would hereby be large and clumsy, which is perceived to be disruptive in clinical environments. A weight increase of the anode plate, and the disproportionate increase of the weight of the radiator (drive components etc.) with this, would additionally hardly allow the rotation speed in the gantry to be increased (as is general development trend requires). The bearing loads would thus require expansive design features.

An additional object of the invention is consequently to not make the anode plate heavier, if possible, and in spite of this to increase its rotation frequency if possible.

As mentioned, if enlarging the plate diameter is not desired, a higher focal spot capacity on the focal path is achieved only by an increase of the rotation speed. In order to avoid or to limit the occurring creep processes, the present invention provides a rotating anode plate for rotating anode x-ray tubes with a curved disc (B) to be positively attached at a drive center (A). The curved disc (B) is composed of a material with high thermal shock resistance that is creep-resistant and simultaneously highly heat conductive. A very high creep resistance of the rotating anode plate is achieved with this measure, with the aid of which the intended load increase can be achieved.

The present invention thus pursues and achieves the goal to not make the anode plate heavier, and to obtain the possibility to increase its rotation frequency. For this the invention provides to bring new materials under the focal spot path in order to transfer the heat more quickly from the focal spot path into the material deeper in the plate, and thereby to avoid a creep of the materials in spite of the higher load temperatures.

The FIGURE shows in a schematic manner a rotating anode plate that fulfills these requirements: a curved disc B is soldered onto the rotor system (thus the drive center) A with positive fit. This disc B advantageously is formed of a ceramic material, preferably from silicon carbide (SiC).

Silicon carbide (SiC) has a thermal expansion similar to that of molybdenum (Mo) but is creep-resistant and, with a density of approximately 3.15 kg/dm$^3$, is approximately 3.2 times lighter than molybdenum (Mo), and has a heat conductivity comparable to that of Mo. What is special about SiC is the high thermal shock resistance; this results from the advantageous combination of thermal expansion, elasticity modulus, heat conductivity and heat storage capacitor. Instead of SiC, other, similar materials (for example Si3N4) are also suitable in a similar manner.

An anode ring D is soldered onto the curved disc B with rigid fit elements C. This ring is advantageously made of graphite, possibly of high capacity graphite with a breaking strength of 80 MPa. In another embodiment, it can also consists of silicon carbide (SiC).

The ring D advantageously contains radially oriented rectangular chambers into which small pyrolytic graphite plates E are inserted. The heat conductive connection from E to the ring material D and to the curved disc C is achieved in a soldering process.

An x-ray-generating layer F (advantageously made of tungsten (W) with or without tungsten-rhenium alloy (WRe)) is subsequently applied on this composite module, advantageously with vacuum plasma spraying.

The formation of chambers into which the pyrolytic plates are inserted (either individually or multiple together) is very helpful because, although the pyrolytic graphite plates do not expand thermally in the plane of their surface, the expansion is extremely high (approximately 24 times $10^{-6}$ $K^{-1}$) in the thickness direction relative to the plane of the surface. Compact bodies are not very stable during temperature changes due to this large value and due to this anisotropic behavior.

The advantage of the described embodiment is that the extremely highly conductive pyrolytic graphite lies directly under the focal spot path. At 1600 M/(m.K), its heat conductivity at room temperature is 12 times as great as that of molybdenum (Mo), thus the material that would otherwise typically be directly under the focal path.

Although the heat conductivity of pyrolytic graphite decreases with increasing temperature, at 800° C. it is still 3.5 times higher than that of molybdenum (Mo) or, respectively, TZM.

To reduced the frozen-in heat stresses from the soldering process, according to one advantageous embodiment of the invention slits G can be introduced that do not need to be continuous; rather, they can also be arranged offset.

To reduce the heat stresses arising from operation, it can be reasonable to introduce (into the graphite and/or into the SiC) slits in the radial direction or slightly angled relative to the radial direction.

Extensive tests have yielded the following with regard to the strength and feasibility proof of the invention: if an outer diameter of 200 mm and an inner diameter of 140 mm are assumed in the FIGURE for the graphite ring D, and if an average density of 2 kg/dm$^3$ is assumed for the components D and E, then a peripheral stress of 28 MPa is obtained in the graphite ring D given a rotation speed of 200 Hz. This is a very acceptable value given that the breaking strength of standard graphite is 50 MPa.

In comparison: a conventional anode plate with inner diameter of 120 mm and outer diameter of 200 mm and a focal path made of tungsten 1 is 1 mm thick; located underneath this is a layer made of 6 mm Mo, and under this is conventionally 30 mm of graphite. The start temperature of the plate is 1000 K, the rotation speed 200 Hz, the focal spot size is 8×1 mm$^2$, the intended load is 100 kW with a duration of 1 second.

A model calculation then delivers the following result after 1 second of load:

the focal spot peak temperature is 2915 K.

However, the upper load limit is approximately 2400 K. A dramatic overloading by 500 K is thus present here.

The temperature curve along the material from the focal path towards the graphite after 1 second has the result that approximately 1700 K is present at the transition from W to Mo, and approximately 1200 K is present at the transition from Mo to graphite.

According to experience, a temperature difference of 1700 K at a transition to Mo or, respectively, TZM quickly leads to the formation of tears given temperature change stress.

A rotating plate according to the invention can have the following structure.

A 1 mm thick layer of tungsten (W) is provided as a focal path. Under this lies a 20 mm thick layer of pyrolytic graphite in the axial direction, with the temperature-dependent heat conductivity typical for this material.

For this calculation, the layer of pyrolytic graphite is 30 mm wide in the radial direction. Under this comes 5 mm SiC with a heat conductivity of 100 W/m.K (assumed to be independent of the temperature) and a temperature-dependent specific heat of 0.7 J/g.K at RT up to 1.3 J/g.K at 1000° C. and a density of 3.21 g/cm$^3$.

A rotating anode plate that complies with the model calculation is an advantageous exemplary embodiment of the invention, resulting in the peak focal path temperature being only 2509 K. A gain of 400 K in the temperature decrease is thus obtained. After 1 second, the temperature curve along the material from the focal path towards the graphite is such that only 1400 K is present at the transition from W to the pyrolytic graphite, and approximately 1020 K is preset at the transition from pyrolytic graphite to SiC. These are temperature values that present no danger for both SiC and Mo/TZM, even given the presence of normal stresses.

In another advantageous embodiment of a light and creep-resistant rotating anode plate according to the invention, the load data calculated as an example show that the operating temperature of the curved disc remains relatively low in the region below the focal path due to the new material sequence and due to the new material insert of pyrolytic graphite. This allows the possibility to even use the conventional TZM material in spite of the high loads.

Experiences with temperature stress in commercially available rotating anode plates leads to the conclusion that the creep data of the material TZM are sufficient to achieve a service life of a rotating anode plate according to the invention that is in the range of the usable duration of the apparatus at the operating site.

Although modifications and changes may be suggested by those skilled in the art, it is the intention of the inventor to embody within the patent warranted hereon all changes and modifications as reasonably and properly come within the scope of his or her contribution to the art.

I claim as my invention:

1. A rotating anode for a rotating anode x-ray tube, said rotating anode comprising:

a curved disc rigidly connected on a rotation center around which said curved disc is caused to rotate;

said curved disc being comprised of a material having a high thermal shock resistance that is also creep-resistant and also highly heat-conductive;

an anode ring applied with rigid fit elements on said curved disc;

said anode ring comprising radially oriented chambers; and a plurality of plates comprised of pyrolytic graphite respectively inserted in said chambers and respectively retained in said chambers by said rigid fit elements.

2. A rotating anode plate as claimed in claim 1 wherein said anode ring comprises a material selected from the group consisting of silicon carbide, silicon nitride, and a molybdenum-titanium-zirconium alloy.

3. A rotating anode plate as claimed in claim 1 wherein at least a surface of said anode ring is comprised of material selected from the group consisting of tungsten and a tungsten-rhenium alloy.

4. A rotating anode as claimed in claim 1 wherein said anode ring has a plurality of slits therein.

5. A rotating anode plate as claimed in claim 1 wherein said curved disc has a plurality of slits therein.

6. A rotating anode plate as claimed in claim 5 wherein said curved disc contains a molybdenum-titanium-zirconium alloy.

7. A rotating anode as claimed in claim 1 wherein said anode ring is soldered onto said curved disc together with said rigid fit elements.

8. A rotating anode as claimed in claim 7 wherein said anode ring is soldered to said curved disc by a soldering connection that produces a heat conducting connection from said crates to said anode ring and said curved disc.

9. A method to fabricate a rotating anode for a rotating anode x-ray tube comprising:

forming a curved disc of a material having a high thermal shock resistance that is also creep-resistant and also highly heat-conductive;

rigidly attaching said curved disc to a rotational mount at a rotation center of said curved disc;

soldering an anode ring onto said curved disc together with a plurality of rigid fit elements, said anode ring comprising radially oriented chambers; and attaching pyrolytic graphic plates to said ring in said chambers with a heated connection, to produce a composite material.

10. A method as claimed in claim 9 comprising an x-ray-generating layer selected from the group consisting of tungsten and a tungsten-rhenium alloy, on said composite material by vacuum plasma spraying.

11. A method as claimed in claim 9 comprising forming slits in said anode ring that reduce frozen-in-thermal stresses arising due to soldering said anode ring onto said curved disc.

12. A method as claimed in claim 9 comprising introducing slits into said curved disc proceeding substantially radially relative to said rotation center, that reduce thermal stresses occurring during operation of said anode plate.

* * * * *